US011324660B2

(12) United States Patent
Geser et al.

(10) Patent No.: US 11,324,660 B2
(45) Date of Patent: May 10, 2022

(54) CONTAINER, CONNECTION AND PRODUCTION DEVICE

(71) Applicant: KOCHER-PLASTIK MASCHINENBAU GMBH, Sulzbach-Laufen (DE)

(72) Inventors: Johannes Geser, Gerlingen (DE); Roland Sauter, Sulzbach-Laufen (DE); Daniel Bojbic, Sulzbach-Laufen (DE); Sven Schneider, Abstgmuend (DE); Torsten Giebeler, Gaildorf (DE)

(73) Assignee: KOCHER-PLASTIK MASCHINENBAU GMBH, Sulzbach-Laufen (DE)

( * ) Notice: Subject to any disclaimer, the term of this patent is extended or adjusted under 35 U.S.C. 154(b) by 223 days.

(21) Appl. No.: 16/645,587

(22) PCT Filed: Sep. 18, 2018

(86) PCT No.: PCT/EP2018/075132
§ 371 (c)(1),
(2) Date: Mar. 9, 2020

(87) PCT Pub. No.: WO2019/063346
PCT Pub. Date: Apr. 4, 2019

(65) Prior Publication Data

US 2020/0276081 A1 Sep. 3, 2020

(30) Foreign Application Priority Data

Sep. 26, 2017 (DE) ..... 10 2017 009 012.2

(51) Int. Cl.
*A61J 1/06* (2006.01)
*A61J 1/14* (2006.01)

(52) U.S. Cl.
CPC ..... *A61J 1/067* (2013.01); *A61J 1/1418* (2015.05)

(58) Field of Classification Search
CPC ..... A61M 5/24; A61M 5/2448; A61M 5/28; A61J 1/067
(Continued)

(56) References Cited

U.S. PATENT DOCUMENTS 5,046,627 A 9/1991 Hansen
7,185,790 B2 * 3/2007 Weiler ..... B65D 1/0238 222/153.06
(Continued)

FOREIGN PATENT DOCUMENTS

DE 28 27 227 1/1980
DE 39 16 840 3/1990
(Continued)

OTHER PUBLICATIONS

International Search Report (ISR) dated Nov. 7, 2018 in International (PCT) Application No. PCT/EP2018/075132.

*Primary Examiner* — Timothy L Maust
(74) *Attorney, Agent, or Firm* — Wenderoth, Lind & Ponack, L.L.P.

(57) ABSTRACT

A container, in particular an ampule, of a plastic material has a container part (10) for receiving the contents of a container (14) to be dispensed via a container opening (12). Opening (12) is closed by a head part (18) that can be separated along a separation line (16). The head part (18) is adjoined by a neck part (20), which has a plurality of different functional surfaces on the inner circumference. One functional contact surface (44) is used to seal against a withdrawal body (32), which is provided for withdrawing the contents of a container (14) when the container opening (12) is opened. A lead-in area (50) is provided as a further functional surface on the interior of the neck part (40) and differs geometrically
(Continued)

from the functional contact surface (44). The lead-in area (50) seamlessly merges into the functional contact surface (44). The lead-in area (50) and the functional contact surface are located between the other functional surfaces in the neck part (20).

30 Claims, 4 Drawing Sheets

(58) Field of Classification Search
USPC ..... 141/319
See application file for complete search history.

(56) References Cited

U.S. PATENT DOCUMENTS

| | | | | |
|---|---|---|---|---|
| 8,486,501 | B2 * | 7/2013 | Manabe | B65D 1/095 428/35.7 |
| 10,363,369 | B2 * | 7/2019 | Cosman | A61M 5/24 |
| 2011/0100861 | A1 | 5/2011 | Manabe et al. | |
| 2014/0039444 | A1 * | 2/2014 | Togawa | A61J 1/065 604/403 |
| 2016/0200484 | A1 | 7/2016 | Cosman | |
| 2020/0276081 | A1 * | 9/2020 | Geser | A61J 1/1481 |

FOREIGN PATENT DOCUMENTS

| | | |
|---|---|---|
| DE | 10 2014 001 446 | 8/2015 |
| EP | 0 489 572 | 6/1992 |
| EP | 2 266 521 | 12/2010 |

* cited by examiner

CONTAINER, CONNECTION AND PRODUCTION DEVICE

FIELD OF THE INVENTION

The invention relates to a container, in particular an ampule, formed of plastic material, having a container part for receiving the contents of the container to be dispensed via a container opening. The container opening is closed by a head part that can be separated along a separation line adjoined by a neck part. The neck part has a plurality of different functional surfaces on its inner circumference. One functional contact surface is used to seal against a withdrawal body, which is provided for withdrawing the contents of a container when the container opening is opened. In addition to the existing functional surfaces, a further functional surface is provided in the form of a lead-in area on the interior of the neck part for a safe withdrawal and a consistent and reliable production. The further functional surface geometrically differs in at least one characteristic from the characteristic of the one functional contact surface.

BACKGROUND OF THE INVENTION

Such containers, which can be connected to a withdrawal body of a withdrawal device for instance by a conical connection, such as a syringe, are regularly used for medical purposes. The conical connection can be lockable (ISO 80369-7: 2016, for instance, a LuerLock connection) or non-lockable (ISO 80369-7: 2016, for instance a Luer-slip connection). These and other connection geometries and their variants, which are used for fluid withdrawal, for instance for enteral (ENFit, ISO 80369-3: 2016) or neuraxial (NRFit, ISO 80369-6: 2016) applications, are described in detail in the listed standards.

The preferred connections for parenteral purposes—for instance, hypodermic syringes—having a cone connection having a cone ratio of 6%, which corresponds to a cone angle of 3.43 degrees, are also referred to in technical language as Luer connections. These known connection geometries use relatively large sealing surfaces, which are used to establish the required secure seal between the elements to be connected over a relatively long conical area. Very good surface qualities are required to ensure the desired secure seal, for instance between injection syringe and injection needle. This secure seal can easily be achieved with injection-molded components using rigid and semi-rigid materials, for instance using plastics such as polycarbonate (PC), styrene acrylonitrile (SAN), polystyrene (PS), etc. This secure seal also results in low "joining forces" for the user. The connection of syringes as a withdrawal device having filled drug containers, however, is particularly challenging.

If a container is to be produced in a cost-effective manner in large quantities and using other plastic materials (polypropylene, polyethylene) as described above, for instance as part of a blow molding process, including preferably the blow molding, filling and closing processes, the occurrence of leaks or leakages during the withdrawal operation from the container by the withdrawal device cannot always be definitely ruled out. These leaks may be associated with an undesired risk to the patient. Therefore, it is important to ensure a sufficient tightness of the withdrawal connection against the entry of possibly contaminated air into the interior of the container on the one hand and, on the other hand, against an unwanted seepage of fluid from the container.

With regard to the requirements explained above, for a generic container in accordance with US 2016/0200484 A1, in addition to the large conical primary sealing surface across the entire neck area (FIGS. 6 to 8), adding an additional secondary seal in the manner of a lip seal at an axial distance has accordingly been proposed. This lip seal opens into the environment after the head part has been severed thereby opening the container, and rests against the withdrawal body of the withdrawal device as soon as the withdrawal body engages with the container.

Two further functional surfaces are arranged between the additional sealing lip at the top and the conical sealing surface at the bottom spaced apart from the sealing lip. The one, third functional surface merges into the conical-sealing surface via a conical inner ledge along a separating seam (FIG. 4). The further fourth functional surface adjoins this third functional surface, merges into the sealing lip and, to that extent, forms a cylindrical peripheral surface at the inner peripheral end of the neck part. The cylindrical peripheral surface is penetrated by the withdrawal body for a withdrawal process. This fourth functional surface in conjunction with the adjacent outer wall parts of the neck part forms two rectangular fixing webs widened in diameter, against the bottom end of which an additional circumferential container wall rests if the container is set up, forming a mounting for the withdrawal system at the outside. The third and fourth functional surfaces, which hold the primary and secondary seals (conical sealing surface and sealing lip) axially spaced apart from each other, comprise the withdrawal body penetrating the container at a radial distance and insofar do not perform a sealing function.

The implementation of a reproducible sealing lip as a secure secondary seal, however, appears difficult, because the thin sealing lip is formed only by the user removing the cap part. As a result, user-specific and handling-related irregularities of the sealing lip cannot be safely ruled out. Their reproducible sealing function is thus questionable.

The required secondary seal naturally causes additional friction between the withdrawal body to be input and/or output and the neck area of the container, resulting in increased actuating or joining forces in establishing the fluid-conveying connection. The increased forces makes handling more difficult, especially if the operator wears the appropriate gloves for reasons of hygiene. In order to be able to safely transfer such increased handling and connection forces, in particular when inputting the withdrawal body, the wall thickness of the neck wall is particularly thick-walled in the area of the contact surface, so as to avoid kinking of the neck part in this area. However, increased actuating forces are necessary to introduce the conical withdrawal body in this area of the neck part having an increased wall thickness by appropriate widening along the functional contact surface.

The two fixing webs diametrically opposite from each other in relation to the container longitudinal axis also form, on the outer circumference of the neck part, the option to clamp the withdrawal device having the withdrawal body accordingly for an open container to form a LuerLock connection. However, the disadvantageous arrangement of the two fixing webs in a common plane transverse to the longitudinal axis of the container frequently results in an over-winding of the locking thread of the withdrawal device, which significantly confuses the user, because he assumes a defect of the container.

SUMMARY OF THE INVENTION

Based on this prior art, the invention addresses the problem of providing an improved container in comparison with the known containers and of providing a manufacturing device, which can be used to produce the container according to the invention in a safe and cost-effective manner.

A container and a manufacturing device according to the invention solve this problem. Further advantageous embodiments of the solutions according to the invention are disclosed.

The container according to the invention is characterized in that a lead-in area in the manner of an additional functional surface seamlessly merges into the functional contact surface and that the lead-in area and the functional contact surface are located between the other functional surfaces in the neck part. The container according to the invention further stands out because the wall thickness in the area of the lead-in area, but in particular in the area of the functional contact surface, is markedly lower than the average wall thickness in the neck part. This lower wall thickness results in the low radial stiffness of the sealing area (partial area of the functional contact surface depending on the individual geometry of the withdrawal body) decisive for secure sealing, because only low forces have to be applied for the expansion of the contact surface by the withdrawal body. Moreover, according to the invention, a design of the functional contact surface, which is as short as possible in the axial direction, is advantageous in order to ensure that the ampule has sufficient torsional stability. This, in turn, is important for the ampule to be opened at the intended separation line and not in the area of the functional contact surface, which would render the container unusable. Moreover, the short design of the functional contact surface prevents buckling or snapping of the container in the neck area during the insertion of the withdrawal body. The term "lead-in area" is aimed at showing that it is located in front of the functional contact surface in the direction the withdrawal body is inserted into the container part. Furthermore, the container according to the invention is particularly preferably produced by a blow molding, filling and closing process, which has become known in the industry as the brand Bottelpack®.

The reduction of the length of the functional contact surface by the seamlessly adjacent lead-in area at the head permits a surprisingly secure seal. At the same time, the force to produce the connection between the withdrawal body and container is reduced. Also, for reasons of a consistent and reliable production of blow-molded ampules, the short-surface pressure having an increased sealing force effect achieved by the invention is preferable to the known surface pressure, because geometric tolerances in the container neck are inherently compensated by the connection process. Thus, within a predefinable tolerance field, due to geometric deviations or deviations in the material structure, an effective seal results between the insides of the container neck part and the withdrawal body at locally high pressing force, but overall reduced total forces due to the reduction of the effective total sealing surface.

In a preferred embodiment of the container according to the invention provision is made that the mentioned differences in the characteristics between the functional contact surface and lead-in area to improve the insertion force of the withdrawal body and the sealing force effect are based on their

- longitudinal extension and/or
- wall thickness in conjunction with adjacent outer wall parts of the neck part and/or
- the inclination of the surface In this way, an actual sealing surface (part of the functional contact surface depending on the geometry of the withdrawal body) having a small width can be implemented, which does not reduce the stability of the neck part as a whole. Also, due to the small width and the low rigidity of the actual sealing area, the requirements for the angular tolerance of the functional contact surface are much lower, which results in particular in improved mass production capabilities if soft materials such as polypropylene (PP) or polyethylene (HDPE, LDPE) are used. In this way, the container according to the invention can be easily produced inexpensively in large quantities as part of a conventional blow molding, filling and closing process.

A radially elastic design of the container opening in the sealing surface area is achieved in particular by reducing the mean wall thickness of the lead-in area and/or functional contact surface in comparison to the mean wall thickness of the other functional surfaces by approx. 20%-50%, preferably 20%-30% by including the adjacent outer wall parts of the individual functional surfaces. That is, there is an overall reduction in wall thickness in the actual so-to-say sealing line area while still providing sufficient axial stiffness to prevent buckling. For low actuation forces, a secure connection is then established for the withdrawal of the contents of a container between the withdrawal body and container.

In a particularly preferred embodiment of the container according to the invention, the functional contact surface forms an abutment cone which has an opening angle of 3.43 degrees (cone angle) or greater relative to the longitudinal axis of the container. The correspondingly determined opening angle of the lead-in area according to the invention is 30 degrees, respectively an oblique inclination of 15 degrees, that is half an opening angle. In particular, if the cone angle of the container in the area of its extraction point is greater than 3.43 degrees with respect to a cone angle of the withdrawal body, for instance in the form of a syringe, having a male cone part of 3.43 degrees or 6% in accordance with ISO 80369-7:2016 is selected, an interference-free connection process for the withdrawal body at low actuation forces and simultaneously very good fluid sealing is achieved. The opening angle of the additional conical lead-in area of 30 degrees is also a contributing factor. A value that on the one hand ensures a high line pressure between the functional contact surface and the withdrawal body. On the other hand, the valve forms an additional insertion aid in the sense of a conical extension for the free end face of the withdrawal body, to further facilitate the insertion process in the direction of the functional contact surface.

In a further preferred embodiment of the container according to the invention provision is made to equip it with further functional surfaces on the inside of the neck part to further brace the neck part. One of the other functional surfaces at its adjacent outer wall part has a locking feature for the withdrawal body, preferably in the form of a threaded section, which is preferably formed of two partial threads. The mounting according to the invention ensures that no unintentional over-tightening can occur when the withdrawal device is screwed onto the withdrawal body, i.e. in any case a secure threaded engagement is realized, in which the sealing cone of a lockable connection is pressed into the counter seat in a sealing manner.

In a further preferred embodiment having a locking option (for instance a LuerLock connection), an increased spacing of more than 3 mm, preferably more than 4 mm, particularly preferably more than 5 mm is provided between the head end of the functional contact surface and the opening. In this way, during the connection process, the engagement with the partial thread is established first, before the sealing pressure is generated. This significantly improves handling for the user.

To be able to safely use withdrawal devices having withdrawal bodies of different lengths (only their minimum length is specified in the standard), it is also advantageous if, after the complete connection, the upper edge of the opened container does not axially abut the withdrawal device. This is achieved—in contrast to the arrangement shown in US 2016/0200484 A1—in that the spacing from the head end of the partial thread to the separation line (the upper edge of the opened ampule) is very small and not more than 2 mm, preferably less than 1 mm.

In a preferred embodiment of the container according to the invention provision is made that at least two webs extend over the functional contact surface and the lead-in area at their adjacent outer wall parts. The webs are preferably arranged diametrically to the longitudinal axis of the container opposite from each other. The free ends of the webs merge into the adjacent outer wall areas of the third and fourth functional surfaces, and thus, largely axially brace the relevant sealing area in the center of the neck part, and increase its section modulus of torsion against unwanted opening in the sealing area, but not significantly increase its radial stiffness.

Another object of the invention is to provide a device for producing such a container or such a connection device. A forming mandrel is used as part of a plastic shaping manufacturing process, which, as a positive mold, maps at least two functional surfaces in the form of the functional contact surface and in the shape of the adjoining additional functional surface as set forth above.

It is particularly preferred in a manufacturing device that the forming mandrel be used in the production of a container, as stated above, as part of a blow molding, filling and closing process. For this purpose, the mandrel is designed as a hollow mandrel.

Other objects, advantages and salient features of the present invention will become apparent from the following detailed description, which, taken in conjunction with the drawings, discloses preferred embodiments of the present invention.

BRIEF DESCRIPTION OF THE DRAWINGS

Referring to the drawings that form a part of this disclosure and that are general and not to scale.

DETAILED DESCRIPTION OF THE INVENTION

Figure 1:
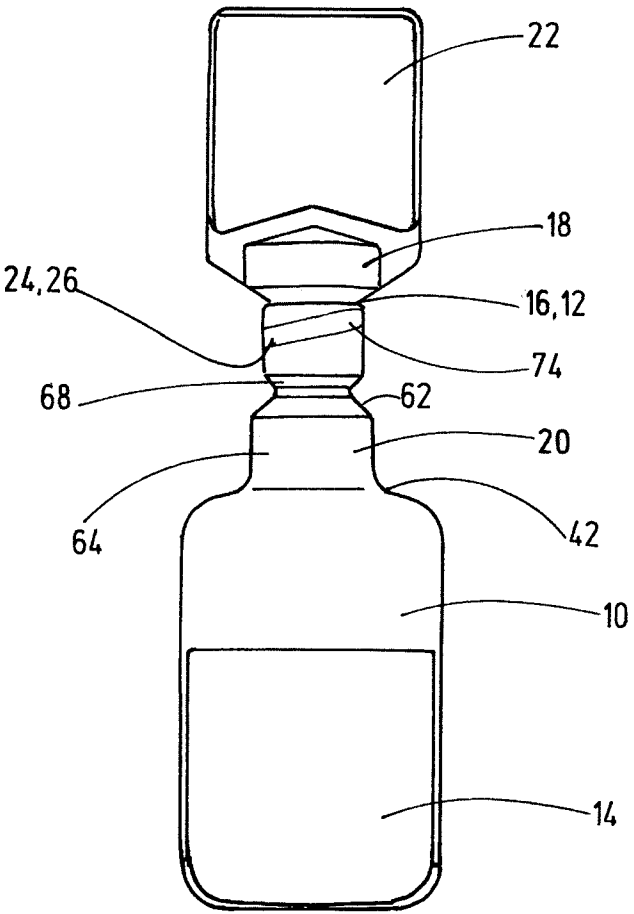
FIG. 1 is a front end view of a filled container in the manner of an ampule according to an exemplary embodiment of the invention.

FIG. 1 shows an integral container as a whole prior to its opening in the form of an ampule of plastic material comprising a container part 10 for receiving liquid or semi-solid the contents 14 of the container 10 for medical purposes or the like that can be dispensed via a container opening 12. The container opening 12 is closed along a separation line 16 by a detachable head part 18. Head part 18 is adjoined by a neck part 20, which merges into the actual container part 10. The head part 18 has a handle 22, which can be used to twist off the head part 18 from the neck part 20 at the separation line 16, thereby opening the container opening 12 using low actuating torques/forces. FIG. 2*b* shows a cross-section of an exposed container opening 12 after the head part 18 has been twisted off by the handle 22, by way of example.

Figure 2A:
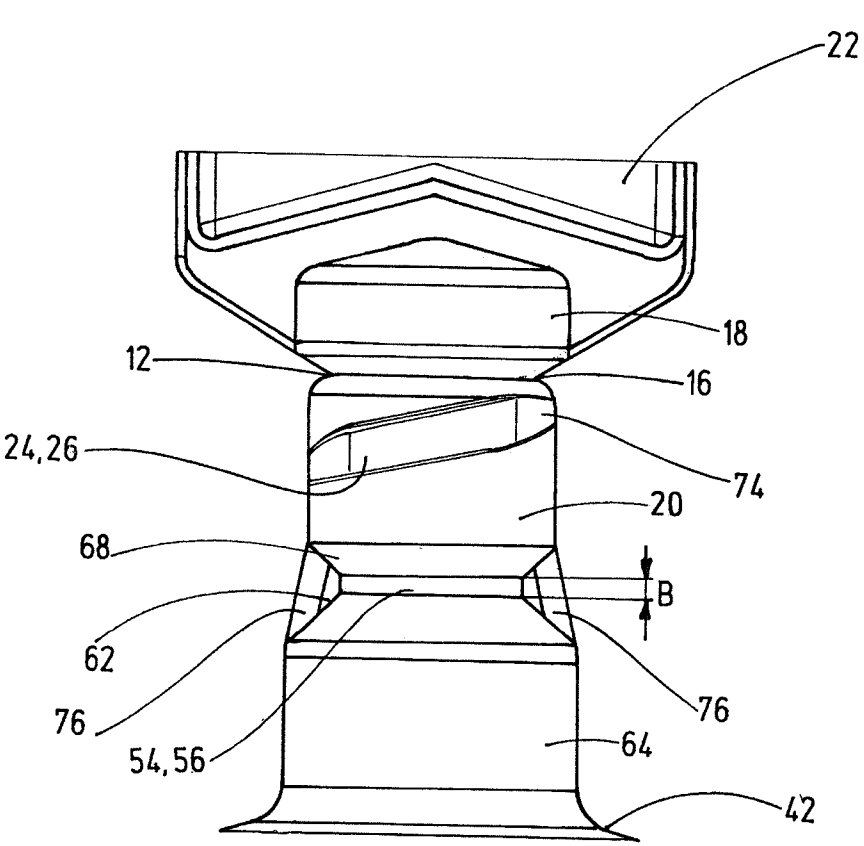
FIGS. 2*a-c* show an enlarged partial front view of an upper part of the container of FIG. 1 before opening (FIG. 2*a*), a partial schematically front view in section after opening (FIG. 2*b*) by removing the head part at the separation line (16) of FIG. 2*a*, and a partial enlarged front view in section of FIG. 2*b*, respectively.
Figure 2C:
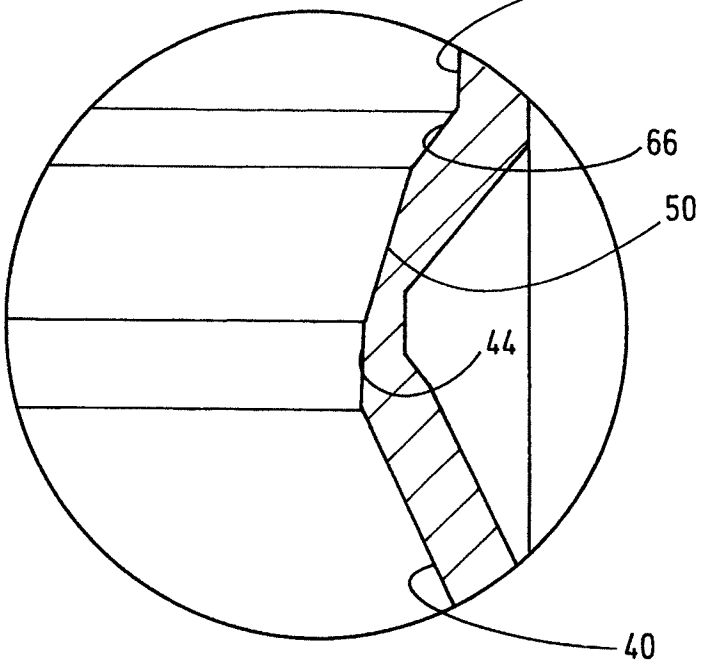
Figure 2B:
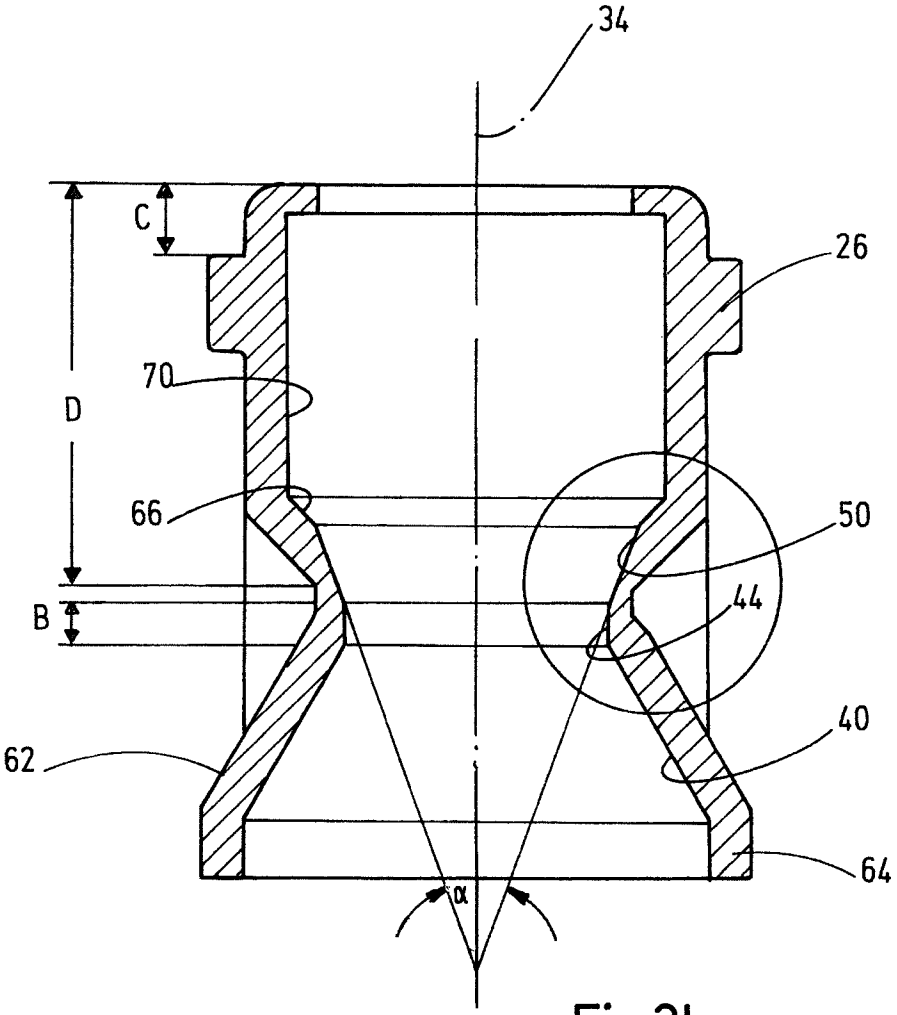
Figure 3:
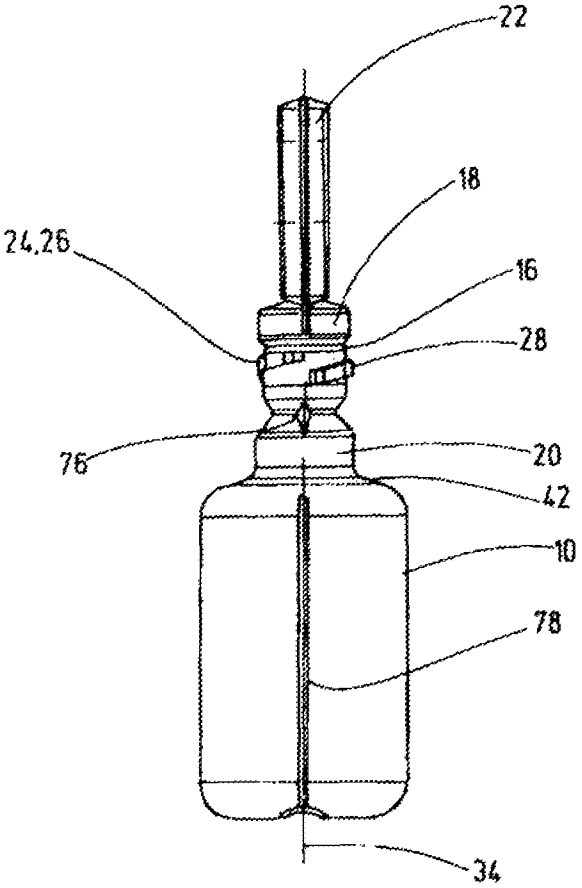
FIG. 3 shows a side view of the container according to FIG. 1.

On the outer circumference, in the upper part of the neck part 20, a part of a threaded section 24 is shown in the manner of a female thread, which in this case is formed of two partial thread sections 26, 28, one partial thread part 26 of which is located at the front of the neck part 20 as shown in FIGS. 1 and 2*a* and one partial thread section 28 of which is located in the rear as shown in the side view of FIG. 3. The mean thread profiles of the two partial thread sections 26, 28 form an angle of 70 to 80 degrees with the longitudinal axis 34 of the container in the area of their rear convergence as shown in FIG. 3. The threaded section 24 on the outer circumference of the neck part 20 is used to lock to a withdrawal device 30 having a tapered withdrawal body 32, as shown in part in FIG. 4, by way of example.

Such a withdrawal device 30 is for instance part of a syringe whose withdrawal body 32 is used to withdraw the contents of the container 14 from the container part 10 when the container opening 12 is opened.

As further shown in FIG. 2*a-c* and FIG. 4, a plurality of different functional surfaces are provided on the inside 40 of the neck part 18. The neck part 20 adjoins a transition bend 42 at the upper end of the container part 10 and extends from bend 42 between the container part 10 up to the separation line 16, to which the head part 18 is attached. One of the functional surfaces mentioned forms a first functional contact surface 44. A part of this functional contact surface 44, dependent on the individual detail geometry of the withdrawal body 32, is used to seal against the withdrawal body 32 of the respective withdrawal device 30. Fictitiously extending the peripheral functional contact surface 44 downwards, these extensions 46 form a cone angle of 3.43 degrees with each other, and thus, form a preferred port having a cone ratio of 6%. The outer wall 48 of the withdrawal body 32 tapering conically downwards has a corresponding inclination. If the withdrawal device 30 having the cone-shaped withdrawal body 32 is completely inserted along the neck part 20 (see FIG. 4), a part of the outer wall 48 is in sealing contact with at least part of the functional contact surface 44. According to the illustration of FIG. 4, the withdrawal device 30 is completely connected and a female thread 38 of the withdrawal device 30 is locked to the neck part 20 via the partial threads 26, 28. A free length tolerance compensation space 61 remains between the head end of the neck part 20 and the withdrawal device 30, which permits the safe use of withdrawal devices 30 having withdrawal bodies 58 of different lengths. According to the invention, this is achieved in that the spacing from the head end of the partial thread to the separation line (the upper edge of the opened ampule) is very small and not more than 2 mm in length, preferably less than 1 mm.

Figure 4:
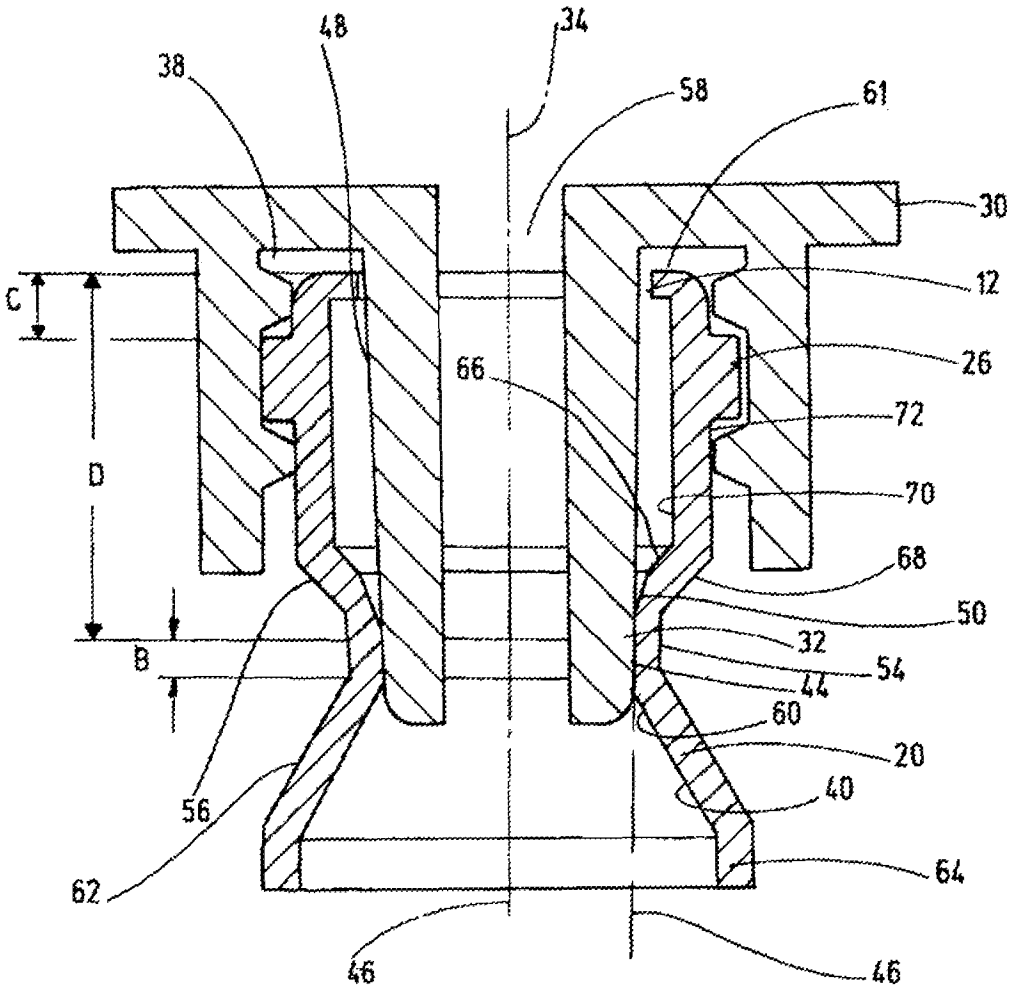
FIG. 4 is a partial front view in section of the connection area of the container of FIG. 1 connected to a lockable conical connection.

Viewed in the direction of FIG. 4, an additional functional surface, the lead-in area 50, is formed at the inside 40 of the neck part 20 above the functional contact surface 44. This additional or second functional surface 50 merges seamlessly into the functional contact surface 44. The lead-in area 50 and the functional contact surface 44 are located in the neck part 20 between the other functional surfaces, which will be explained in more detail below. In particular, at least one characteristic of the lead-in area 50 differs from that of the functional contact surface 44 seamlessly adjoining at the end of the container body.

In any case, the individual difference in the characteristics between functional contact surface 44 and additional lead-in area 50 has to be used to ensure that an increased sealing pressure can act on the inserted withdrawal body 32 for a reduced sealing surface. On the one hand, provision is made in particular for the functional contact surface 44 to be designed having a small width or axial length B (see FIG. 4, but not to scale), where B is less than 3 mm, preferably less than 2 mm, particularly preferably less than 1 m.

Furthermore, provision is made that, taking into account the adjacent rotationally symmetrical outer wall part 54 of the functional contact surface 44 and the outer wall part 56 of the additional functional surface 50, the average wall thickness at least in a partial area of the functional contact surface 44 and/or a partial area of the lead-in area 50 is reduced by approximately 20%-50%, preferably approximately 20%-30%, with respect to the average wall thickness in area of the other functional surfaces 66, 70. This reduced thickness has to be based on a mean wall thickness, as at least the functional surfaces 44 and 50 have a corresponding inclination, whereas in particular according to the illustrations of FIGS. 1 to 3, the outer circumference of the outer wall parts 54, 56 is mainly cylindrical. The average wall thickness in the above-mentioned sealing area including the two functional surfaces 44, 50 is thus less than 4 mm, preferably less than 3 mm, particularly preferably less than 2 mm. This wall thickness results in a very favorable elastic design of the container opening or ampule opening in the sealing area in the radial direction, due to a corresponding reduction in wall thickness. Thus, viewed in the axial longitudinal extent of the container body 10, in the neck part 20 a high axial stiffness is achieved to prevent any indentations during the insertion of/connection to the withdrawal body 32.

In a particularly preferred embodiment, however, provision is made for the similarly determined opening angle alpha of the additional lead-in area to be approximately 10 to 50 degrees, preferably 20-40 degrees, particularly preferably 30 degrees, relative to the contact cone of the peripheral contact surface 44. As a result, a tilt-safe insertion is possible, which can be done applying little force and without the formation of abrasion particles. This is very advantageous compared to the prior art (US 2016/0200484 A1), in which a sealing lip must be fitted for an improved seal at the free end area of the neck part.

Accordingly, in the solution according to the invention, a high local pressing force, a quasi-line pressing force, results in an improved seal. Due to a reduced sealing surface, overall lower total forces are required to introduce the withdrawal device 30 having the withdrawal body 32 in its final withdrawal position in the neck part 20 of the container or the ampule. This is without parallel in the prior art.

In a further preferred embodiment having a locking option (for instance a LuerLock connection), an increased spacing D (see FIG. 4) of more than 3 mm, preferably more than 4 mm, particularly preferably more than 5 mm is provided between the head end of the functional contact surface 44 and the opening 12. In this way, during the connecting process first the partial threads engage before the sealing pressing between a part of the functional contact surface 44 and the withdrawal body is produced. This considerably facilitates the connection between the withdrawal device and the container.

For an improved sealing and an improved introduction of the withdrawal body 32, it may moreover be provided that in particular the functional contact surface 44 forms a contact cone, which opens an angle of more than 3.43 degrees with respect to the longitudinal axis 34 of the container (corresponding to a 6% cone ratio according to ISO 80369-7: 2016). Surprisingly, it has been found that, despite different cone angles a secure sealing can be achieved between the—at 3.43 degrees standard—cone of the withdrawal body 32 and the container 10 according to the invention.

The radially elastic functional surfaces 44 and 50 having a small width or axial length B provide a quasi-linear sealing area, which is largely insensitive to geometric tolerances, surface damage and the like, thus rendering a pressure-tight usage of the container below and above atmospheric pressure possible.

As further shown in FIG. 4, there is a transition surface as a further third functional surface 60 on the inside 40 of the neck part 20, which opens into the container part 10. Starting from the contact surface 44, functional surface 60 has an outwardly projecting transition cone 62. Viewed downwards in the direction of FIG. 4, the transition cone 62 merges into a cylindrical transition piece 64, which integrally merges within the limits of the transition arc 42 as part of the neck part 20 into the container part 10, which is formed as a holding option within a predetermined hollow volume for the contents of a container 14. At the outer and inner peripheral ends in each case, the pertinent transition piece 64 is formed as a circular or oval hollow cylinder piece.

Viewed in the direction of view of FIG. 4, a further transition cone 68 is provided as a further fourth functional surface 66, adjacent to the further functional surface 50, the direction of inclination of which extends opposite of that of one of the transition cones 62, i.e. the further transition cone 68 widens upwards in the opposite direction. The fourth functional surface 66 merges into a fifth functional surface 70 at the inner peripheral end in the direction of the connected head part 18 or in the direction of the opened container opening 12, which fifth functional surface has a locking option for the withdrawal device 30 in the form of at least one threaded section 24 (FIGS. 1, 2 and 3) at its adjacent outer wall part 72 and shown only schematically in FIG. 4 providing mounting 74 for the withdrawal device.

As cannot be seen in the view of FIG. 4, but which is shown in FIG. 2*a*, at least two webs 76 extend over the functional contact surface 44 and the additional lead-in area 50 at their adjacent outer wall areas or outer wall parts 54, 56. The free ends of those webs in each case merge integrally formed on the adjacent outer wall parts in the form of the respective transition cones 62, 68 into the associated area of the third and fourth functional surfaces 60 and 66. The webs 76 are used for axial bracing and for bracing in the circumferential direction and are, as shown in FIG. 2, located diametrically opposite from each other in relation to the longitudinal axis of the container 34 on the outside of the neck part 20. For ease of illustration, these webs 76 have been omitted in FIG. 1. As FIG. 3 shows the container part 10 without contents 14 of the container and further illustrates further bracing webs 78 can be arranged in a vertical plane coplanar with the webs 76 on the outside of the container part 10. Such webs 78 are used to connect the individual container or the ampule as part of a conventional carton composite to further containers or ampules of a type in a row and in a common plane or orientation next to each other as merchandise (not shown) during manufacture, before any separation.

Figure 5:
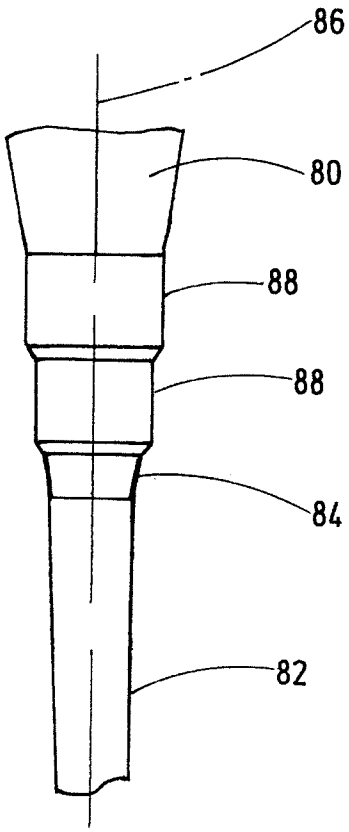

A further solution according to the invention is aimed at providing a device for producing a container according to FIGS. 1 to 4 or a connecting device, which uses a forming mandrel 80 as part of a molding plastic manufacturing process. Mandrel 80 is in the form of a positive mold according to the illustration of FIGS. 5 and 6 and forms at least two different shaping surfaces 82, 84. In the course of the shaping process, surfaces 82, 84 correspond in terms of their design to the functional contact surface 44 or to the adjoining functional surface 50. In particular, the forming mandrel 80 can be used in the production of a container according to the embodiment according to FIGS. 1 to 4 as part of a conventional blow molding, filling and closing process (BFS or Bottelpack® process), which is described in more detail by way of example with reference to a corresponding production device according to DE 10 2014 001 446 A1.

Figure 6:
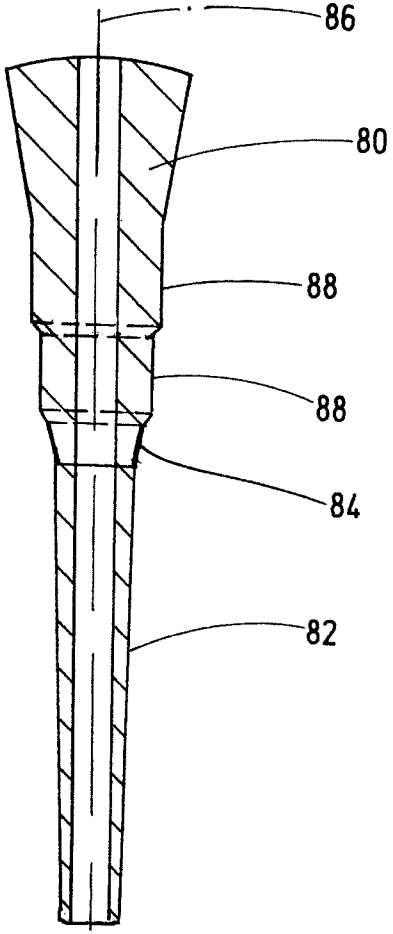
FIGS. 5 and 6 are a partial front view and a partial front view in section, respectively, of sections of a filling mandrel for producing a neck part and filling a container according to FIGS. 1 to 4 according to an exemplary embodiment of the invention.

As shown particularly in FIG. 6, the forming mandrel 80 is formed as a hollow mandrel and has the forming surface 82 on its underside or lower end, which forming surface later generates the 3.43 degree cone angle for the conical functional contact surface 44. In addition, the forming surface 82 is disposed on the outer circumference of the forming mandrel 80 which, viewed in the longitudinal axis 86 of the mandrel 80, forms a preferred cone angle of 30 degrees with the longitudinal axis or in the manner of a preferred 15 degree gradient. Above the molding surface 84, further molding surfaces 88 are arranged in superimposed arrangement as a third type of molding surfaces having different diameters, which are used to produce further functional surfaces 66, 70 in the neck part 20; which may optionally also be used for co-forming the head part 18.

The solution according to the invention has been explained in detail essentially with reference to lockable and non-lockable conical connections in accordance with ISO803669-7:2016, but can easily be transferred in an analogous manner to withdrawal devices/withdrawal bodies having other geometries, such as those for enteral (ISO 80369-3:2016) or neuraxial administration (ISO 80369-6: 2016, including, but not limited to, spinal or epidural anesthesia and intrathecal chemotherapy).

The solution according to the invention provides a container or an ampule having a special connecting device or another connection device, which can be produced cost-effectively and reliably as part of a blow-fill-seal method, the BFS method. Low handling forces and/or handling torques are required to safely establish the connections for a transfer of a fluid, based on a standardized withdrawal body, below and above atmospheric pressure. Soft plastic materials such as polypropylene (PP) or polyethylene (HDPE, LDPE) can be used for the container without further ado.

While various embodiments have been chosen to illustrate the invention, it will be understood by those skilled in the art that various changes and modifications can be made therein without departing from the scope of the invention as defined in the claims.

The invention claimed is:

1. A container of plastic material, the container comprising:

a container part capable of receiving contents dispensable via a container opening;

a head part closing the container opening along a separation line and being removable from a neck part extending between the head part and the container part along the separation line;

a plurality of different functional surfaces on an inner circumference of the neck part including a first functional surface arranged to form a seal against a withdrawal body of a withdrawal device capable of withdrawing the contents from the container part when the container opening is open and including a second functional surface forming a lead-in area having different geometric properties from the first functional surface and seamlessly merging into the first functional surface, the first and second functional surfaces being between other functional surfaces in the neck part; and a container thread on an outside of the neck part capable of engaging a female thread on the withdrawal device.

2. A container according to claim 1 wherein the container thread comprises first and second partial threads having mean thread courses forming angles of approximately 70 to 80 degrees relative to a longitudinal axis of the container.

3. A container according to claim 1 wherein the different geometric properties of the first and second functional surfaces include longitudinal extensions, wall thicknesses in conjunction with adjacent outer wall parts of the neck part and inclinations along entire lengths thereof.

4. A container according to claim 1 wherein the first functional surface is capable of exerting an increased sealing pressure on the withdrawal body inserted therein for a reduced sealing surface.

5. A container according to claim 1 wherein the first functional surface is capable of exclusively creating a sealing effect with the withdrawal body inserted in the neck part via the container opening and is capable of at least partially abutting an outer surface of the withdrawal body inserted in the neck part forming a sealing surface.

6. A container according to claim 1 wherein a mean wall thickness of the neck part at the first functional surface is reduced by approximately 20-50 percent relative to mean wall thicknesses of outer wall parts of the neck part adjacent to the first functional surface.

7. A container according to claim 1 wherein a mean wall thickness of the neck part at the first functional surface is reduced by approximately 20-30 percent relative to mean wall thicknesses of outer wall part of the neck part adjacent to the first functional surface.

8. A container according to claim 1 wherein the first functional surface has a contact cone having an opening angle of 0 to 10 degrees.

9. A container according to claim 8 wherein the opening angle is 2 to 5 degrees.

10. A container according to claim 9 wherein the opening angle is 3 to 5 degrees.

11. A container according to claim 1 wherein the lead-in area is cone-shaped with an opening angle of 10 to 40 degrees.

12. A container according to claim 11 wherein the opening angle is 20 to 40 degrees.

13. A container according to claim 12 wherein the opening angle is 25 to 35 degrees.

14. A container according to claim 2 wherein
the separation line is spaced from the first partial thread by a distance not more than 2 mm.

15. A container according to claim 14 wherein
the distance is less than 1 mm.

16. A container according to claim 1 wherein
a head end of the first functional surface closest to the head part is spaced from the container opening by a distance greater than 3 mm.

17. A container according to claim 16 wherein
the distance is greater than 4 mm.

18. A container according to claim 16 wherein
the distance is greater than 5 mm.

19. A container according to claim 1 wherein
the plurality of different functional surfaces includes a third functional surface being a transition surface opening into the container part and extending from the first functional surface outwardly in a shape of a cone.

20. A container according to claim 19 wherein
the plurality of different functional surfaces includes a fourth functional surface extending from the second functional surface toward the head part and being in a shape of a cone tapering toward the second functional surface.

21. A container according to claim 20 wherein
the plurality of different functional surfaces includes a firth functional surface extending from the fourth functional surface in a direction of the head part, the container thread section being on an outside of the neck part opposite the fifth functional surface.

22. A container according to claim 20 wherein
first and second webs extend over outer walls of the neck part opposite the first and second functional surfaces, free ends of the first and second webs merge into and are connected to outer walls of the neck part opposite the third and fourth functional surfaces adjacent the first and second functional surfaces, respectively.

23. A container according to claim 1 wherein
the container part contains an enteral fluid.

24. A container according to claim 1 wherein
the container part contains parenteral fluid.

25. A container according to claim 1 wherein
the container part contains neural fluid.

26. A container of plastic material, the container comprising:

a container part capable of receiving contents dispensable via a container opening;

a head part closing the container opening along a separation line and being removable from a neck part extending between the head part and the container part along the separation line;

a plurality of different functional surfaces on an inner circumference of the neck part including a first functional surface arranged to form a seal against a withdrawal body of a withdrawal device capable of withdrawing the contents from the container part when the container opening is open and including a second functional surface forming a lead-in area having different geometric properties from the first functional surface and seamlessly merging into the first functional surface and being cone-shaped with an opening angle of 10 to 40 degrees, the first and second functional surfaces being between other functional surfaces in the neck part.

27. A container according to claim 26 wherein
the opening angle is 20 to 40 degrees.

28. A container according to claim 27 wherein
the opening angle is 25 to 35 degrees.

29. A container of plastic material, the container comprising:

a container part capable of receiving contents dispensable via a container opening;

a head part closing the container opening along a separation line and being removable from a neck part extending between the head part and the container part along the separation line;

a plurality of different functional surfaces on an inner circumference of the neck part including a first functional surface arranged to form a seal against a withdrawal body of a withdrawal device capable of withdrawing the contents from the container part when the container opening is open and including a second functional surface forming a lead-in area having different geometric properties from the first functional surface and seamlessly merging into the first functional surface and including an additional functional surface extending from the second functional surface toward the head part and being in a shape of a cone tapering toward the second functional surface, the first and second functional surfaces being between other functional surfaces in the neck part.

30. A container according to claim 29 wherein
The other functional surfaces include a further functional surface extending from the additional functional surface in a direction of the head part, a mounting for the withdrawal device being on an outside of the neck part opposite the further functional surface.

* * * * *